US011759857B2

(12) United States Patent
Eichenberger et al.

(10) Patent No.: US 11,759,857 B2
(45) Date of Patent: Sep. 19, 2023

(54) MATERIAL OBTAINED BY COMPACTION AND DENSIFICATION OF METALLIC POWDER(S)

(71) Applicant: ETA SA Manufacture Horlogere Suisse, Grenchen (CH)

(72) Inventors: Jean-Claude Eichenberger, Moutier (CH); Hung Quoc Tran, Bienne (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 17/193,309

(22) Filed: Mar. 5, 2021

(65) Prior Publication Data

US 2021/0187608 A1 Jun. 24, 2021

Related U.S. Application Data

(63) Continuation of application No. 16/064,314, filed as application No. PCT/EP2016/078201 on Nov. 18, 2016, now Pat. No. 10,987,732.

(30) Foreign Application Priority Data

Dec. 21, 2015 (EP) ..... 15201640

(51) Int. Cl.
*B22F 3/02* (2006.01)
*C22C 9/02* (2006.01)
(Continued)

(52) U.S. Cl.
CPC ..... *B22F 3/16* (2013.01); *B22F 1/052* (2022.01); *B22F 3/02* (2013.01); *B22F 5/08* (2013.01); *C22C 1/0425* (2013.01); *C22C 9/02* (2013.01); *C22C 9/04* (2013.01); *C22C 19/002* (2013.01); *C22C 19/03* (2013.01); *C22C 30/02* (2013.01); *C22C 30/06* (2013.01); *G04B 1/145* (2013.01);
(Continued)

(58) Field of Classification Search
None
See application file for complete search history.

(56) References Cited

U.S. PATENT DOCUMENTS 4,147,568 A 4/1979 Marechal
4,270,114 A 5/1981 Cannom
(Continued)

FOREIGN PATENT DOCUMENTS

CN 104959609 A 10/2015
JP S48-025978 A 4/1973
(Continued)

OTHER PUBLICATIONS

International Search Report dated Feb. 13, 2017, in PCT/EP2016/078201 filed Nov. 18, 2016.
(Continued)

*Primary Examiner* — George Wyszomierski
(74) *Attorney, Agent, or Firm* — Oblon, McClelland, Maier & Neustadt, L.L.P.

(57) ABSTRACT

The invention relates to a compacted and densified metal material having one or more phases formed of an agglomerate of grains, the cohesion of the material being provided by bridges formed between grains, said material having a relative density higher than or equal to 95% and preferably higher than or equal to 98%.

24 Claims, 3 Drawing Sheets

= Nickel = Bronze = Brass

(51) Int. Cl.

| | |
|---|---|
| ***B22F 3/16*** | (2006.01) |
| ***C22C 9/04*** | (2006.01) |
| ***G04B 15/14*** | (2006.01) |
| ***C22C 19/00*** | (2006.01) |
| ***C22C 19/03*** | (2006.01) |
| ***G04B 17/06*** | (2006.01) |
| ***B22F 5/08*** | (2006.01) |
| ***G04B 1/14*** | (2006.01) |
| ***C22C 30/02*** | (2006.01) |
| ***C22C 30/06*** | (2006.01) |
| ***G04B 31/06*** | (2006.01) |
| ***G04B 13/02*** | (2006.01) |
| ***C22C 1/04*** | (2023.01) |
| ***B22F 1/052*** | (2022.01) |
| *B22F 9/08* | (2006.01) |

(52) U.S. Cl.

CPC ..... *G04B 13/02* (2013.01); *G04B 15/14* (2013.01); *G04B 17/066* (2013.01); *G04B 31/06* (2013.01); *B22F 2009/0828* (2013.01); *B22F 2301/10* (2013.01); *B22F 2301/15* (2013.01); *B22F 2301/30* (2013.01); *B22F 2303/15* (2013.01); *B22F 2304/10* (2013.01); *B22F 2998/10* (2013.01); *B22F 2999/00* (2013.01)

(56) References Cited

U.S. PATENT DOCUMENTS

| | | | | |
|---|---|---|---|---|
| 5,061,439 | A | 10/1991 | Nyrhila | |
| 2011/0262763 | A1 | 10/2011 | Aslund | |
| 2012/0274437 | A1 | 11/2012 | Matsuura | |
| 2013/0025409 | A1* | 1/2013 | Xu | B22F 1/17 75/228 |
| 2015/0239045 | A1 | 8/2015 | Aslund | |
| 2016/0076137 | A1* | 3/2016 | Shin | C22C 16/00 419/30 |
| 2016/0325356 | A1 | 11/2016 | Hirata | |
| 2018/0085830 | A1* | 3/2018 | Lou | B22F 3/24 |
| 2020/0362438 | A1* | 11/2020 | Tsukamoto | C22C 14/00 |

FOREIGN PATENT DOCUMENTS

| | | | |
|---|---|---|---|
| JP | H03-505350 | A | 11/1991 |
| JP | 2015-205485 | A | 11/2015 |
| WO | WO 02/38315 | A1 | 5/2002 |
| WO | WO 2010/080064 | A1 | 7/2010 |

OTHER PUBLICATIONS

Chinese Office Action dated Nov. 25, 2020, issued in Chinese Patent Application No. 201680079730.2 (with English translation).

* cited by examiner

= Nickel = Bronze = Brass

= Nickel = Bronze = Brass

MATERIAL OBTAINED BY COMPACTION AND DENSIFICATION OF METALLIC POWDER(S)

CROSS REFERENCE TO RELATED APPLICATIONS

The present application is a continuation application of U.S. Ser. No. 16/064,314, filed on Jun. 20, 2018, now U.S. Pat. No. 10,987,732 issued Apr. 27, 2021, which is a 35 U.S.C. § 371 national stage patent application of International patent application PCT/EP2016/078201, filed on Nov. 18, 2016, and claims the benefit of the filing date of European application no. 15201640.8, filed on Dec. 21, 2015, the entire contents of each of which is incorporated by reference.

SUBJECT OF THE INVENTION

The present invention relates to a material and to the method of manufacturing the same by powder metallurgy. An intended field of application of this new material is that of mechanics, and more precisely, micromechanics. It is even more specifically suited for components having complex geometries with strict tolerances, as in horology for example.

BACKGROUND OF THE INVENTION AND PRIOR ART

Materials obtained by powder metallurgy are of considerable technological importance and are used in a wide range of fields, ranging from nuclear to biomedical.

By way of example, U.S. Pat. No. 5,294,269 and US Patent 2004/0231459 can be mentioned, which respectively disclose a method for sintering tungsten-based alloys and a cermet. Without going into detail, the interactions between powder particles (surface and volume diffusion) during sintering drastically modify the microstructure and distribution of the initially mixed powders. The result is a product with properties specific to this new microstructure.

SUMMARY OF THE INVENTION

The present invention proposes to select the composition of starting powders in accordance with the desired properties of the end product and to adapt the parameters of the method to limit interactions between the powders and thus obtain the expected properties based on the initial selection of powders.

To this end, the invention concerns a compacted and densified metal material comprising one or more phases formed of an agglomerate of grains, the cohesion of the material being provided by bridges formed between grains, said material having a relative density higher than or equal to 95% and preferably higher than or equal to 98%, the external surface of the grains having an irregular random shape comprising hollows and peaks.

The irregular random shape of the grains, and particularly of their external surface, including irregularly shaped hollows and peaks, allows the grains to bind by entanglement to each other during the manufacturing process, prior to the compacted powder densification step and without having to use any binder.

Advantageously, the grains have different sizes and the grain size distribution varies from 1 to at least 4, and according to a particular embodiment, the material includes at least two phases and the difference in grain size distribution between the at least two phases is at least a factor of 4.

This grain size distribution, together with the external surface topology of the grains with a random irregular shape including hollows and peaks, advantageously makes it possible to maximise the contact surfaces between grains and thereby facilitate the binding and cohesion of the grains during compaction to form a stable agglomerate in the manufacturing process prior to the compacted powder densification step and without the need to use any binder. During the densification step, the grain size distribution together with the external surface topology of the grains advantageously allows the creation of numerous microwelds thus contributing to the good mechanical properties of the end product.

The invention also concerns a method for making a material by powder metallurgy comprising the following steps:

providing one or more metallic powders having grains with a random irregular shape including hollows and peaks, compacting the metallic powder or powders to form a compacted assembly, in which the grains are bound to each other by entanglement of their respective hollows and peaks, to form an intermediate product in the form of an agglomerate exclusively comprised of metallic powder grains, densifying by impact the compacted agglomerate assembly at a temperature below the melting temperature of the powder having the lowest melting temperature, the assembly being brought to said temperature, prior to or during densification, for a time comprised between 3 and 30 minutes and preferably between 5 and 20 minutes.

It will be noted that according to this method, the agglomerate formed at the end of the compaction step advantageously does not require the use of any binder and that the grains are held to each other simply through the physical interaction of the respective external surfaces of the grains. A debinding step is thus no longer necessary. At the end of the densification step, the grains are permanently bound to each other by microwelds at their interfaces. The solid thus obtained has sufficient mechanical properties for use in the production of various components, without going through a subsequent sintering or other operation.

BRIEF DESCRIPTION OF THE DRAWINGS

The features and advantages of the present invention will appear upon reading the detailed description below with reference to the following Figures.

In FIG. 5, this is a two-phase sintered solid (U.S. Pat. No. 5,294,269). The white represents the heavy phase mainly formed of tungsten. The black phase is the metal binder phase, essentially composed of a nickel, iron, copper, cobalt and molybdenum alloy. In FIG. 6, it is a sintered cermet (US 2004/0231459). Binder is the binder phase composed of a 347SS stainless steel. The ceramic phase is composed of TiC (titanium carbide). The last phase is formed of $M_7C_3$ precipitates, where M contains chromium, iron and titanium.

DETAILED DESCRIPTION OF THE INVENTION

Figure 1:
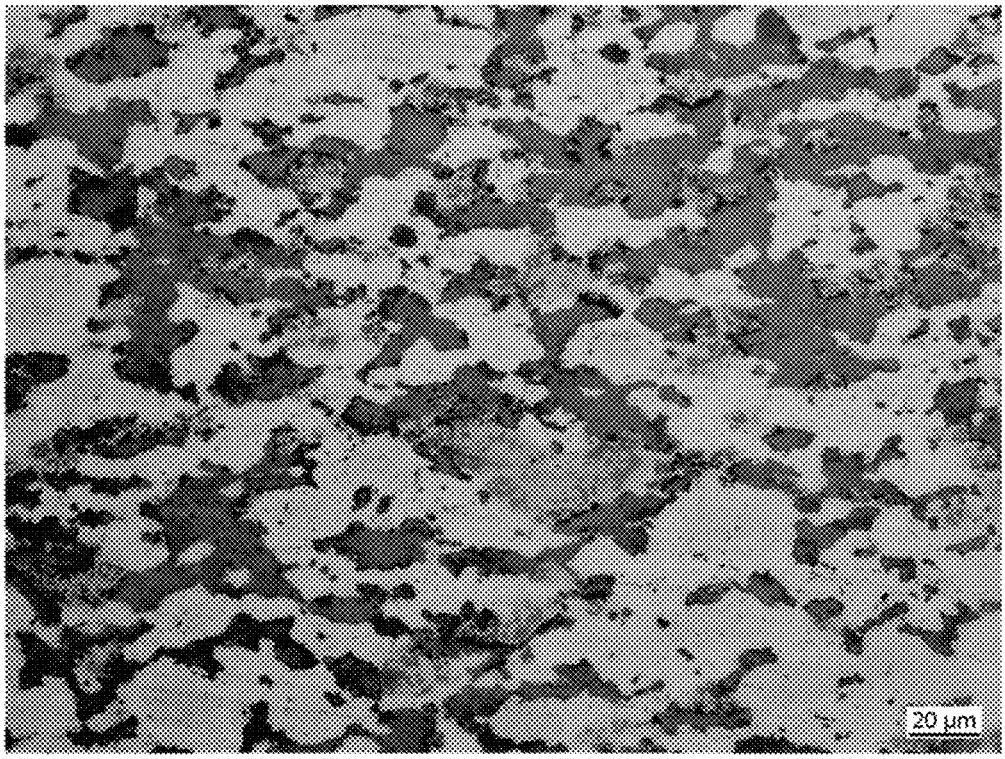
FIG. 1 represents the microstructure of a three-phase material obtained by the method according to the invention. Densification was performed at a temperature close to 500° C. on a compacted mixture of nickel, brass and bronze.

The present invention relates to a method for making a material by powder metallurgy and to the material obtained by this method. The method is adapted so that the microstructure of the material is perfectly homogeneous through its volume and so that it is the most accurate possible image of the microstructure of the mixed powders and their initial distribution in the mixture. The material obtained by the method may be a finished product or a semi-finished product requiring a subsequent machining step.

The material is a metallic material obtained by a method comprising three steps.

The first step consists in selecting one or more metallic powders and in dosing them out when several powders are present. They may be pure metal powders or alloy powders. The number of starting powders, their composition and their respective percentages depend upon the desired physical and mechanical properties of the consolidated product. Preferably, there is a minimum of two powders in order to combine the properties specific to different compositions. Each powder is formed of particles having a selected particle size to ensure the quality of the material. Although dependent on the desired properties, the mean diameter $d_{50}$ is preferably selected within a range of between 1 and 100 μm.

The metallic powder(s) are selected from the non-exhaustive list comprising pure metals or alloys of titanium, of copper, of zinc, of iron, of aluminium, of nickel, of chromium, of cobalt, of vanadium, of zirconium, of niobium, of molybdenum, of palladium, of copper, of silver, of tantalum, of tungsten, of platinum and of gold. For example, the mixture includes three powders: a nickel powder, a bronze powder and a brass powder. The proportion of bronze powder is comprised between 2 and 20% by weight, the proportion of nickel powder is comprised between 3 and 40% by weight, the proportion of brass powder being the remaining proportion (=100%−the sum of the percentages of nickel and bronze). For bronze and brass, the percentages of Cu, Sn and Cu, Zn can be respectively modulated. For example, for brass, the Cu and Zn content may be 60% and 40% respectively and for bronze, the Cu and Sn content may be 90% and 10% respectively.

In a second step, the different powders are mixed. The mixing is carried out in a standard commercial dry mixer. The mixer settings and mixing time are chosen so that, at the end of this step, the mixture is completely homogeneous. Generally, the mixing time is more than 12 hours to ensure homogeneity and less than 24 hours. It should be noted that, where only one starting powder is present, the mixing step is optional.

In a third step, the homogeneous mixture is shaped, i.e. compacted and densified at a temperature below the melting point of the respective powders. Compaction and hot densification are carried out using impact compaction technology, as described in WO Patent Application No. 2014/199090. Thus, the mixed powders are placed inside a cavity made in a die and the mixture is compacted using a punch. Then, the compacted mixture is hot densified by subjecting the punch to one or more impacts. Unlike the method described in WO Patent Application No. 2014/199090, the pressurized cooling step can be omitted.

The parameters of the method are selected to obtain a consolidated body with a relative density higher than or equal to 95% and preferably higher than or equal to 98%, while limiting interactions between the various powders. The objective is to form a microweld between particles to consolidate the material without significantly altering the microstructure of the various powders present. More specifically, the consolidation parameters are selected to limit the degree of sintering to surface bond formation and not volume bond formation as observed during a classical sintering. In microstructural terms, this intergranular bond results in the formation of bridges between particles. Limiting the interactions between particles maintains a powder distribution within the consolidated material close to that observed after mixing the powders. Impact compaction and densification of the mixture of powders thus welds the powder grains to each other while maintaining a microstructure with high energy interfaces between the different constituent phases. In other words, the characteristic of the material obtained by the method is that the constituent elements of the different powders do not mix, and the morphology of the basic particles is retained after compaction and densification. Similarly, where there is only one starting powder, the grain morphology of the material obtained is an image of the particle morphology of the initial powder, which is advantageous for ensuring the mechanical properties based on the initial choice of powder morphology.

To obtain this specific microstructure, the powder mixture is at a temperature below the melting point of the powder with the lowest melting point during hot densification. The mixture is brought to this temperature for a time comprised between 3 and 30 minutes and preferably between 5 and 20 minutes. It can be brought to this temperature prior to introduction into the press or once inside the press. The time mentioned above includes the heating time to reach the given temperature and maintaining at this temperature. During densification, the mixture is subjected to a number of impacts comprised between 1 and 50 with an energy level comprised between 500 and 2000 J, this level preferably being 10 to 30% higher than the energy level required during compaction. The product thus obtained has a relative density higher than or equal to 95% and preferably higher than or equal to 98%, measured in a conventional manner using Archimedes' weighing principle. After this densification step, a metallurgic cut reveals a very specific microstructure resulting from the method for shaping the material. The material includes a number of phases corresponding to the number of initial powders with substantially the same phase distribution as that of the powders within the starting mixture. Another very specific characteristic of this microstructure is that the consolidated phase surface energy is kept at high levels. The native morphology of the powder particles is almost entirely retained with an irregularly-shaped interface between phases, which can be described as non-spherical. The consolidated phases thus maintain a high specific surface area.

Figure 2:
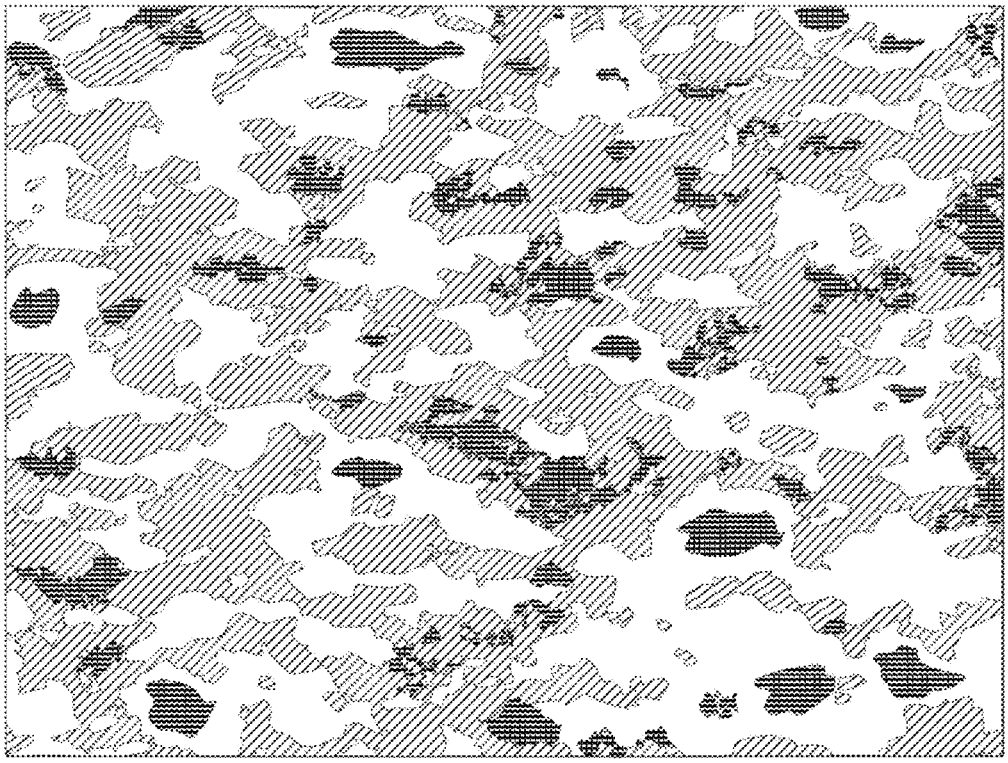
FIG. 2 represents the same microstructure after image processing to show the different phases.
Figure 3:
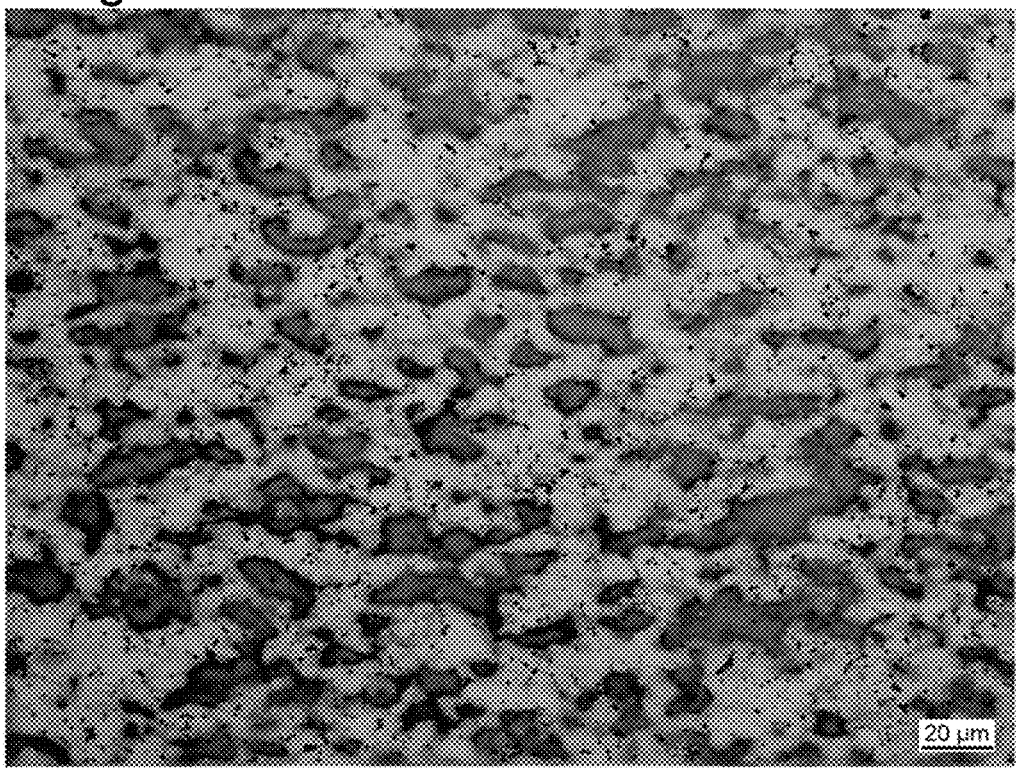
FIGS. 3 and 4 represent the microstructure of the same three-phase material when densification is performed at a temperature close to 700° C.
Figure 4:
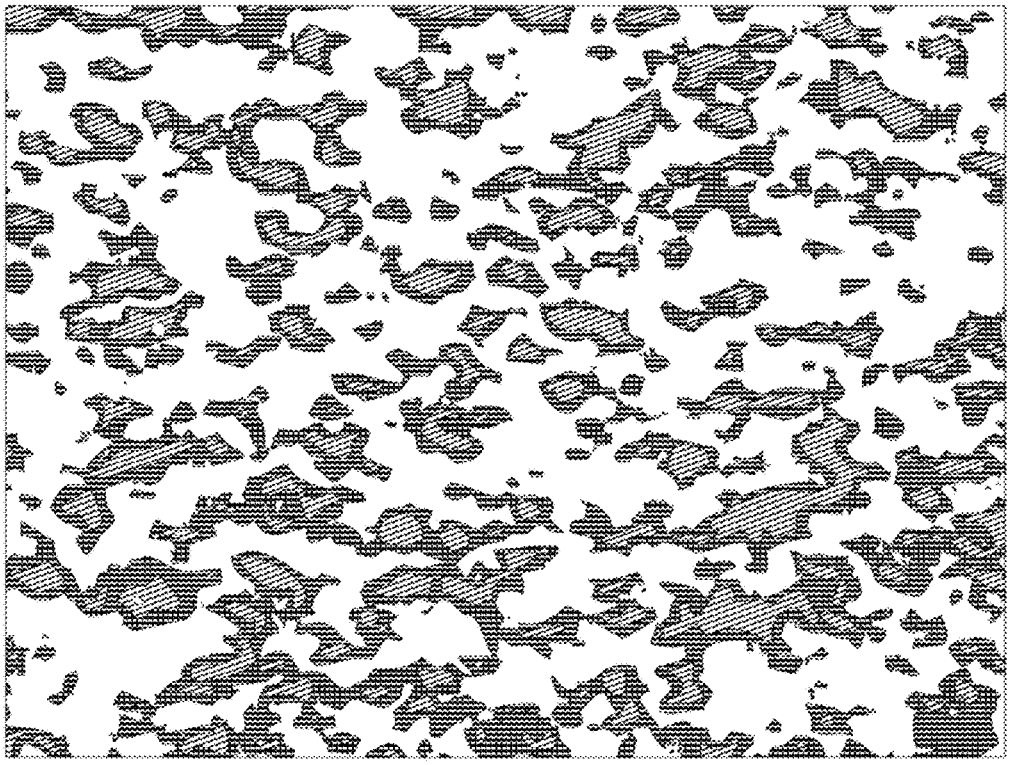

By way of example, FIGS. 1 and 2 show the microstructure obtained starting from a mixture of three powders: nickel, bronze, brass, as set out in Table 1. The mixture was compacted and densified at a temperature close to 500° C. The microstructure has three distinct phases respectively formed mostly of nickel, bronze and brass. The homogeneity of the mixture obtained is that obtained after the step of mixing the three types of powder. The product thus obtained has a relative density of more than 95%. Starting from the same mixture, but with a densification temperature close to 700° C., FIGS. 3 and 4 show the same microstructure homogeneity with three distinct phases. However, interdiffusion is observed between the two nickel/bronze and bronze/brass pairs, the nickel-rich phase being surrounded by the bronze-rich phase. This interdiffusion allows the relative density to be increased to a value higher than or equal to 98%.

Figure 5:
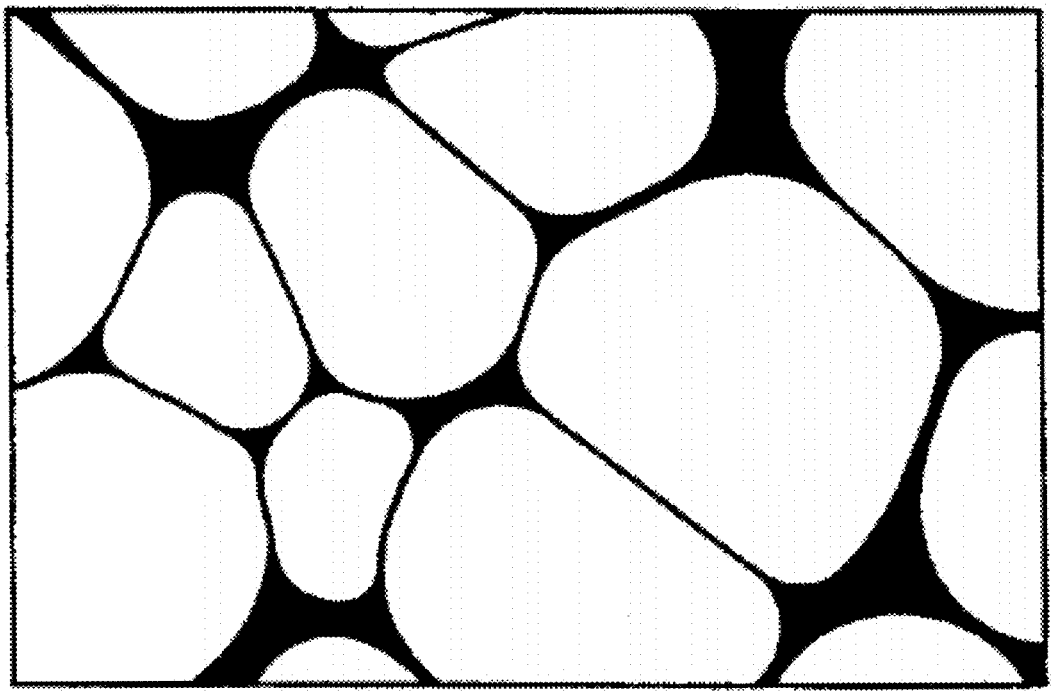
FIGS. 5 and 6 represent, by way of comparison, the microstructures of prior art materials obtained by powder metallurgy.
Figure 6:
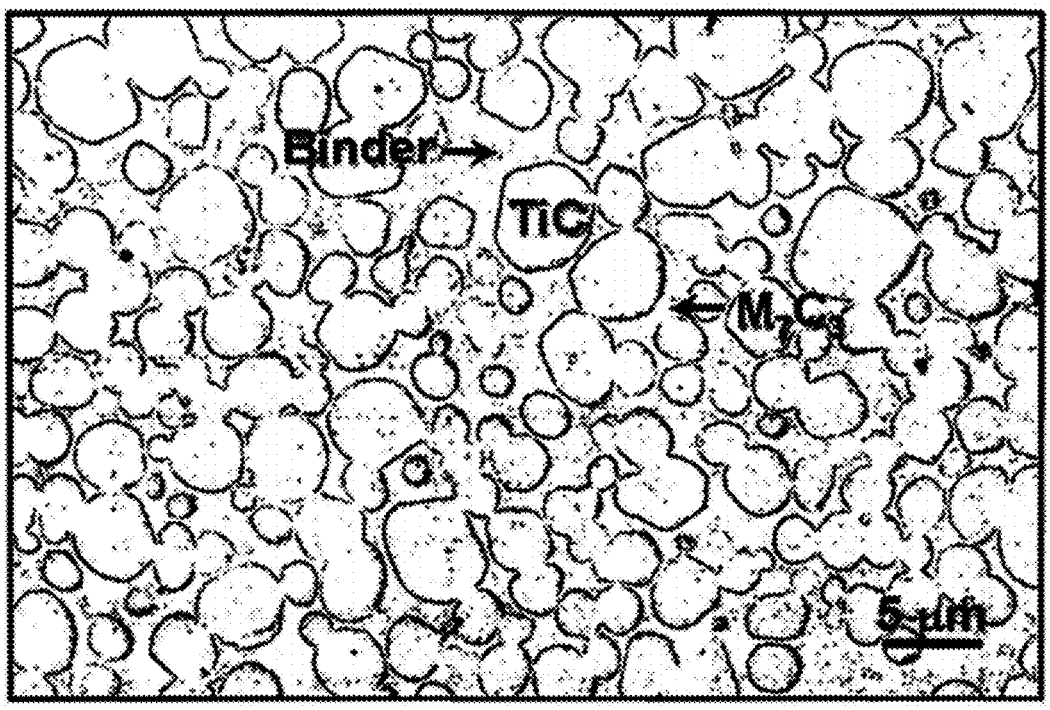

By comparison, with the materials obtained by powder metallurgy in U.S. Pat. No. 5,294,269 and 2004/0231459 (FIGS. 5 and 6 respectively), a clear difference is observed at the interfaces separating the different phases. In these documents, the interfaces are smooth and, more specifically, of essentially spherical shape, unlike the material according to the invention which has irregular interfaces, i.e. high energy interfaces, between the phases.

A detailed example below illustrates the method according to the invention.

In the first step, the powders were selected to form a material having a set of properties:

- easy shaping of the semi-finished product by a chip removal machining process with no burr,
- dimensional stability, to prevent deformation of the material after the machining operation,
- weldable, especially by laser welding.

To meet these criteria, three metal powders included in Tables 1 and 2 below were selected in step 1) of the method. The function of each powder is detailed in Table 1. The compositions and percentages of the various powders are detailed in Table 2.

TABLE 1

| Selected powders | Function and/or characteristic |
|---|---|
| Pure nickel metal powder (Ni) | Offers the consolidated and densified material good welding behaviour, particularly for laser welding |
| Brass alloy metal powder, with a nominal chemical composition of 60% copper (Cu) and 40% zinc (Zn). | Offers good machinability |
| Bronze alloy metal powder, with a nominal chemical composition of 90% copper (Cu) and 10% tin (Sn). | Offers better consolidation and densification behaviour |

TABLE 2

| Type of powder | Powder content (by weight) | Grain size (μm) (supplier's data) | Nominal chemical composition of the material (by weight) | | | |
|---|---|---|---|---|---|---|
| | | | Ni | Cu | Zn | Sn |
| Nickel powder (100% Ni)* | 25% | Fisher size: 1.8-2.8 | 25% | | | |
| Brass powder (60% Cu, 40% Zn)** | 65% | d10: 2<br>d50: 6<br>d90: 20 | | 48% | 26% | 1% |
| Bronze powder (90% Cu, 10% Sn)*** | 10% | d10: 6<br>d50: 11<br>d90: 20 | | | | |

*Eurotungstene Ni2800A powder
**Nippon Atomized Metal Powders Corp. SF-BS6040 10 μm powder
***Nippon Atomized Metal Powders Corp. SF-BR9010 10 μm powder In the second step, the powders were mixed in a Turbula T10B type shaker-mixer. The mixing speed is an average speed of around 200 rpm for 24 hours.

In the third step, the shaping was performed using a high velocity, high energy press made by Hydropulsor.

Shaping was Performed in Two Phases:

Cold Compaction

The powders are dosed in the cavity in a volumetric manner with a given filling height. In the example, this filling height is 6 mm to achieve a compacted thickness of around 2 mm. This parameter—filling height—can vary between 2 mm and 50 mm according to the desired final thickness of the compacted solid. The quantity of dosed powder is compacted between the top punch and bottom punch, surrounded by a die to form a disk of a given diameter. This compaction is performed in the example with 25 impacts. The objective of this step is to obtain a solid that is sufficiently dense for the subsequent hot densification. The compaction also serves to ensure the compacted solid is sufficiently solid to be manipulated during hot densification. The relative density obtained in this step is higher than 90%.

Hot Densification

The compacted disc is brought to a temperature close to 700° C. in a furnace preheated to this temperature. The compacted disc is placed in the furnace for at least 5 minutes and preferably 15 minutes. The heated disc is transported and placed in the cavity whose diameter is slightly larger than the diameter of the disc. The time taken to transport the preheated disc from the furnace to the press and place in the die, is comprised between 2 and 5 seconds. The preheated disc is then hot densified between the top punch and bottom punch with 25 impacts. In the absence of heating means, a drop in temperature is observed during densification by impact. The final thickness in the example of the densified disc is around 1.8 mm. The relative density of the disc is higher than 98%. The microstructure is similar to that obtained in FIG. 3.

As a result of the compaction and hot densification described above, the resulting solid is a multi-phase material including phases with different functions. Further, the resulting solid has a homogeneous microstructure throughout its volume. Consequently, there is no internal stress gradient through the solid.

This gives the machined part geometrical stability.

Each phase of the resulting solid and, beforehand, each powder, is selected to perform a specific function. One of the phases can be chosen to improve weldability, for example, by laser. This function is performed by the phase composed mainly of nickel in the example. Another phase may be chosen to facilitate hot densification without actual sintering. In the example, one of the solid phases is essentially formed of bronze, which has the lowest melting range of the three constituents. The third phase which, again as an example, is the majority phase, consists of the consolidated brass powder. Mixed with the other two phases, this phase ensures better chip removal machinability.

Where there is only one starting powder, the method according to the invention also has advantages. It is thus observed that the morphology of the grain within the material is an image of the particle morphology of the starting powder. As grain size plays an important part in the mechanical properties of the material, it is particularly advantageous to be able to predict the final properties based on the choice of the starting powder morphology.

As a result of the method according to the invention, the morphology of the starting powder(s) is maintained while obtaining a product of high relative density unlike the known sintering method where consolidation at relative density values higher than or equal to 95, or even 98% is accompanied by a drastic change in morphology.

The method of the invention applies mutatis mutandis to the second example with three metallic powders set out in Tables 3 and 4 below. The function of each powder is detailed in Table 3. The compositions and percentages of the various powders are detailed in Table 4.

Example 2: Lead-Free Brass

TABLE 3

| Selected powders | Function and/or characteristic |
|---|---|
| Cu30Zn Brass alloy powder, with a nominal chemical composition of 70% copper (Cu) and 30% zinc (Zn). | Offers good machinability and better filling behaviour |
| Cu40Zn Brass alloy powder, with a nominal chemical composition of 60% copper (Cu) and 40% zinc (Zn). | Offers good machinability |
| Pure zinc metal powder (Zn) | Offers better consolidation and densification behaviour |

TABLE 4

| Type of powder | Powder content (by weight) [%] | Grain size (μm) (supplier's data) [μm] | Nominal chemical composition of the material [%] (by weight) Cu | Zn |
|---|---|---|---|---|
| Cu30Zn Brass powder (70% Cu, 30% Zn)* | 45 | 45 (30-50%)<br>63 (15% max.)<br>106 (0%) | 58-59 | 41-42 |
| Cu40Zn Brass powder (60% Cu, 40% Zn)** | 45 | d10: 2<br>d50: 6<br>d90: 20 | | |
| Zinc powder (100% Zn)*** | 10 | 4-6 | | |

*NEOCHIMIE BRASS POWDER 70/30
**Nippon Atomized Metal Powders Corp. SF-BS6040 10 μm powder
***NEOCHIMIE ZINC DUST EF POWDER It will be noted that, in this example, a small amount of zinc in very small grain size has the function of improving the agglomerate consolidation effect prior to the densification step, but that it could be omitted in a variant, the proportion of two types of brass powder would then be substantially equal.

The invention claimed is:

1. A compacted and densified solid metallic material comprising one or more phases formed of an agglomerate of metallic powder grains, wherein:

cohesion of the densified solid metallic material is provided by metallic bridges formed through direct surface bonds between the metallic powder grains, said densified solid metallic material has a relative density greater than or equal to 95%, and an external surface of each of the metallic powder grains in the densified solid metallic material has an irregular random shape comprising hollows and peaks.

2. The material according to claim 1, wherein the phase or phases comprise at least one element selected from the group consisting of Ni, Cu, Zn, Ti, Al, Fe, Cr, Co, V, Zr, Nb, Mo, Pd, Ag, Ta, W, Pt, Au and alloys thereof.

3. The material according to claim 1, wherein the grains have different sizes.

4. The material according to claim 1, wherein the material comprises at least two phases and wherein a difference in the relative sizes of the grains between the at least two phases are at least a factor of 4.

5. The material according to claim 1, comprising at least two phases wherein interfaces between the phases have an irregular random shape.

6. The material according to claim 1, comprising three phases wherein interfaces between the phases have an irregular random shape.

7. The material according to claim 1, wherein an entire outer surface of one powder grain is directly bonded to other powder grains.

8. A component comprising a compacted and densified solid metallic material comprising one or more phases formed of an agglomerate of uncoated metallic powder grains, wherein:

cohesion of the densified solid metallic material is provided by metallic bridges formed through direct surface bonds between the metallic powder grains, said densified solid metallic material has a relative density greater than or equal to 95%, and an external surface of each of the metallic powder grains in the solid metallic material has an irregular random shape comprising hollows and peaks.

9. The component according to claim 8, wherein the component is a horological component.

10. The component according to claim 8, comprising at least two phases wherein interfaces between the phases have an irregular random shape.

11. The component according to claim 8, comprising three phases wherein interfaces between the phases have an irregular random shape.

12. The component according to claim 8, wherein an entire outer surface of one powder grain is directly bonded to other powder grains.

13. A method for making the material of claim 1 by powder metallurgy, comprising:

compacting one or more metallic powders having grains with a random irregular shape including hollows and peaks, to form a compacted assembly, in which the grains are bound to each other by entanglement of their respective hollows and peaks, to form an intermediate product in a form of an agglomerate exclusively comprised of metallic powder grains, and densifying by impact the agglomerate at a temperature below a melting temperature of the powder having the lowest melting temperature, the assembly being brought to said temperature, prior to or during densification, for a time between 3 and 30 minutes.

14. The method according to claim 13, further comprising mixing the powder or powders prior to compaction.

15. The method according to claim 13, wherein the powder or powders are one or more selected from the group consisting of the following pure metals: Ni, Cu, Zn, Ti, Al, Fe, Cr, Co, V, Zr, Nb, Mo, Pd, Ag, Ta, W, Pt, Au and alloys thereof.

16. The method according to claim 13, wherein the powder or powders have grains of different sizes.

17. The method according to claim 13, wherein the material comprises at least two phases and wherein a difference in relative sizes of the grains between the at least two phases is at least a factor of 4.

18. The method according to claim 13, comprising compacting at least two powders of different compositions.

19. The method according to claim 13, comprising compacting three powders, a first powder being a nickel powder, a second powder being a brass powder and a third powder being a bronze powder.

20. The method according to claim 19, wherein a percentage of the nickel powder is between 3 and 40%, a percentage of the bronze powder is between 2 and 20%, and a percentage of the brass powder corresponds to a remaining percentage, such that a total percentage of the nickel powder, bronze powder, and brass powder sums to 100%, the percentages being expressed by weight.

21. The method according to claim 19, wherein Cu and Zn content of the brass powder is 60% and 40%, respectively, and wherein Cu and Sn content of the bronze powder is 90% and 10%, respectively.

22. The method according to claim 13, wherein the densifying by impact is performed at a temperature greater than or equal to 500° C.

23. The method according to claim 13, wherein the compaction is cold compaction.

24. The method according to claim 13, wherein a number of impacts during densification is between 1 and 50 with an energy between 500 and 2000 J.

* * * * *